US008342728B2

(12) United States Patent
Biebl et al.

(10) Patent No.: US 8,342,728 B2
(45) Date of Patent: Jan. 1, 2013

(54) ARRANGEMENT FOR COOLING SEMICONDUCTOR LIGHT SOURCES AND FLOODLIGHT HAVING THIS ARRANGEMENT

(75) Inventors: Alois Biebl, St. Johann (DE); Stefan Dietz, Otterfing (DE)

(73) Assignee: OSRAM GmbH, Munich (DE)

( * ) Notice: Subject to any disclaimer, the term of this patent is extended or adjusted under 35 U.S.C. 154(b) by 351 days.

(21) Appl. No.: 12/812,939

(22) PCT Filed: Jan. 14, 2008

(86) PCT No.: PCT/EP2008/050324

§ 371 (c)(1),
(2), (4) Date: Jul. 14, 2010

(87) PCT Pub. No.: WO2009/089903

PCT Pub. Date: Jul. 23, 2009

(65) Prior Publication Data

US 2011/0051449 A1 Mar. 3, 2011

(51) Int. Cl.
*F21V 29/00* (2006.01)
*F21V 29/02* (2006.01)

(52) U.S. Cl. ..... 362/547; 362/545; 362/294; 362/373; 362/218; 165/104.33; 165/104.26

(58) Field of Classification Search ..... 362/543–548, 362/294, 218, 373; 165/104.33, 104.26
See application file for complete search history.

(56) References Cited

U.S. PATENT DOCUMENTS

| | | | | |
|---|---|---|---|---|
| 6,910,794 | B2 | 6/2005 | Rice | |
| 7,210,832 | B2 * | 5/2007 | Huang | 362/547 |
| 7,284,874 | B2 * | 10/2007 | Jeong et al. | 362/97.1 |
| 7,683,395 | B2 * | 3/2010 | Huber et al. | 257/99 |
| 8,016,024 | B2 * | 9/2011 | Kang et al. | 165/104.26 |
| 2003/0042314 | A1 | 3/2003 | Tsikos et al. | |
| 2003/0227774 | A1 * | 12/2003 | Martin et al. | 362/240 |
| 2004/0213016 | A1 * | 10/2004 | Rice | 362/547 |
| 2006/0002142 | A1 * | 1/2006 | Jeong et al. | 362/612 |
| 2006/0092639 | A1 * | 5/2006 | Livesay et al. | 362/294 |
| 2006/0104077 | A1 | 5/2006 | Oshio et al. | |
| 2008/0137337 | A1 * | 6/2008 | Cheng et al. | 362/249 |
| 2008/0247177 | A1 * | 10/2008 | Tanaka et al. | 362/373 |
| 2009/0135594 | A1 * | 5/2009 | Yu et al. | 362/234 |
| 2010/0157606 | A1 * | 6/2010 | Roucoules et al. | 362/294 |

FOREIGN PATENT DOCUMENTS

| | | |
|---|---|---|
| EP | 0 501 699 | 2/1992 |
| EP | 1 643 188 | 4/2006 |
| FR | 2 889 291 | 2/2007 |
| JP | 2004127782 A * | 4/2004 |
| JP | 2006-164967 | 6/2006 |
| JP | 2006-286395 | 10/2006 |

(Continued)

*Primary Examiner* — Mariceli Santiago
(74) *Attorney, Agent, or Firm* — Cozen O'Connor

(57) ABSTRACT

An arrangement for cooling semiconductor light sources (5), wherein the semiconductor light sources (5) are arranged on a heat-conducting module (11), which is operatively connected to an evaporator zone (27) of a heat pipe (20), wherein a first condensation zone (23) of the heat pipe (20) is connected to a first heat sink (33), wherein the heat pipe (20) is connected to at least one second condensation zone (25) with at least one second heat sink (25), and a heat flow can be switched over between the condensation zones (23, 25) or the second condensation zone (25) can be switched in.

16 Claims, 6 Drawing Sheets

FOREIGN PATENT DOCUMENTS

| | | | |
|---|---|---|---|
| JP | 2007147257 A | * | 6/2007 |
| WO | WO 2006/031023 | | 3/2006 |
| WO | WO 2006/052022 | | 5/2006 |
| WO | WO 2007/019733 | | 2/2007 |

* cited by examiner

ARRANGEMENT FOR COOLING SEMICONDUCTOR LIGHT SOURCES AND FLOODLIGHT HAVING THIS ARRANGEMENT

RELATED APPLICATIONS

This is a U.S. national stage of application No. PCT/EP2008/050324, filed on Jan. 14, 2008, the entire content of which is hereby incorporated by reference.

FIELD OF THE INVENTION

The invention relates to an arrangement for cooling semiconductor light sources, wherein the semiconductor light sources are arranged on a heat-conducting module, which is operatively connected to an evaporator zone of a heat pipe, and a first condensation zone of the heat pipe is connected to a first heat sink. The arrangement is suitable for all types of headlights/spotlights/floodlights, for example, but in particular for headlights in the motor vehicle sector.

BACKGROUND OF THE INVENTION

The term heat pipe hereinafter denotes a device in the form of a pipe which can transport large amounts of thermal energy between its two ends by means of evaporation/condensation of a working fluid.

US2004/213016 A1 discloses a cooling system for automotive light arrangements, which cools the semiconductor light sources by means of a heat pipe with a heat sink situated at a distance from the semiconductor light sources.

WO2006/52022 A1 discloses a motor vehicle headlight comprising semiconductor light sources that are cooled by means of a heat pipe. In this case, the heat sink is positioned above the semiconductor light sources at the rear side of the headlight. The problem arises, however, that the waste heat of the semiconductor light sources would often be needed elsewhere as heating heat. However, since the heating is usually intended to be regulated, the arrangement described above is not usable in such a case.

SUMMARY OF THE INVENTION

It is an object of the invention to provide an arrangement for cooling semiconductor light sources, wherein the semiconductor light sources are arranged on a heat-conducting module, which is operatively connected to an evaporator zone of a heat pipe, and a first condensation zone of the heat pipe is connected to a first heat sink, and the arrangement can simultaneously feed the entire or part of the thermal energy to a different use.

It is furthermore an object of the invention to provide a method which serves for cooling semiconductor light sources and in which the entire or part of the thermal energy is simultaneously fed to a different use.

This and other objects are attained in accordance with one aspect of the invention directed to an arrangement for cooling semiconductor light sources, wherein the semiconductor light sources are arranged on a heat-conducting module, which is operatively connected to an evaporator zone of a heat pipe, and a first condensation zone of the heat pipe is connected to a first heat sink, wherein the heat pipe is connected to a second condensation zone with a second heat sink, and a heat flow can be switched over between the condensation zones. One of the heat sinks can thus be used as regulated heating for other purposes since, by means of the switching over of the heat flow, it is possible at any time to switch to the second heat sink, and, consequently, no limitation occurs during the operation of the semiconductor light sources. In this case, the second heat sink is designed such that it can absorb the waste heat of the semiconductor light sources at any time.

Another aspect of the invention is directed to a method for cooling semiconductor light sources with an arrangement as described above, comprising the steps of: switching on a first condensation zone upon activation; upon a predetermined temperature of the first condensation zone being exceeded, switching off the first condensation zone and switching on a second condensation zone or switching in a second condensation zone; and upon a predetermined temperature of the first condensation zone being undershot, switching over to the first condensation zone or switching off the second condensation zone.

Advantageously, the switching over of the condensation zones takes place by means of a 3-way valve. In this case, the 3-way valve contains a permanent-magnetic double cone, wherein the cone vertices respectively alternately close off the evaporator pipe of a condensation zone. This has the advantage that a cooling path is always open and failure of the semiconductor light sources on account of overheating is therefore precluded. By virtue of this construction, a magnetic drive of the double cone is possible, which generates no problems with regard to sealing.

As an alternative, a 2-way valve is also conceivable, in which only one condensation zone is switched on and off. This has the advantage that a first cooling path into a first condensation zone is always open, while a second cooling path into a second condensation zone can be supplementarily switched in as required.

Preferably, the double cone closes off only the evaporator pipe and not the capillary region of the heat pipe.

As a result, working fluid flowing back can pass into the working circuit again, which leads to increased efficiency and operating reliability. In this case, the drive of the double cone is arranged outside the heat pipe and is effected magnetically. Outside the heat pipe there is usually enough space available for the drive and no sealing measures are necessary as a result of the magnetic drive.

In this case, the heat sink (33) of the first condensation zone (23) is preferably operatively connected to a heating device.

As a result, the waste that arises can advantageously be utilized for a different task.

Upon the semiconductor light sources being switched on, the evaporator pipe is advantageously open to the first condensation zone and the evaporator pipe is closed off to the second condensation zone. The condensation zones are switched over depending on the temperature of the first condensation zone. As a result, the abovementioned heating device can be embodied in regulated fashion and this priority switching enables defined operation of the arrangement for cooling semiconductor light sources.

In one embodiment, the power feed of the semiconductor light sources is effected via the heat pipe. This has the advantage of a simpler and more reliable construction. In the case of a coaxial construction of the heat pipe, simple and cost-effective pipes can be used as the power feed, wherein the two poles of the power feed are formed by the two coaxial pipes.

BRIEF DESCRIPTION OF THE DRAWINGS

The invention is explained in greater detail below on the basis of exemplary embodiments. In the figures.

DETAILED DESCRIPTION OF THE DRAWINGS

Figure 1:
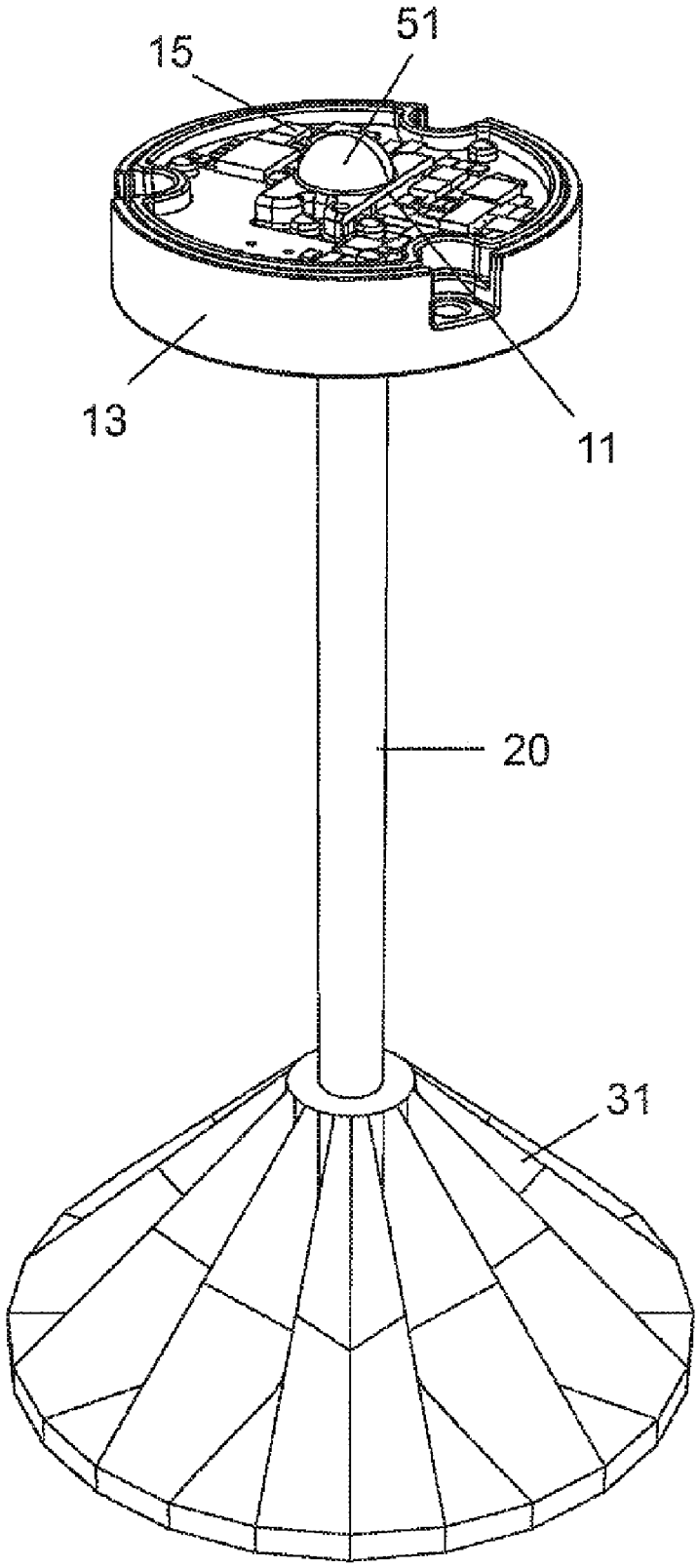
FIG. 1 shows a perspective view of a semiconductor light source module connected to a heat pipe with a rosette-shaped cooling body connected to the heat pipe in an embodiment according to the prior art.

FIG. 1 shows an embodiment of an arrangement for cooling semiconductor light sources according to the prior art, having only one condensation zone, which is enclosed by a rosette-shaped cooling body 31, which dissipates the condensation heat that arises. A multichip light emitting diode 5 (not shown) with an attached primary optical unit 51 is fitted on a light emitting diode module 11. The light emitting diode module 11 is produced from a material having good thermal conductivity in order that the heat loss that arises from the multichip light emitting diode 5 can be dissipated rapidly and reliably. The light emitting diode module 11 is embedded into a housing 13, which, alongside the light emitting diode module 11, also has a driving electronic unit 15 for the multichip light emitting diode 5. In this case, the housing 13 is made from a material having poor thermal conductivity in order to minimize the thermal loading of the driving electronic unit 15 by the multichip light emitting diode 5. A heat pipe 20 leads from the light emitting diode module 11 to a cooling body 31.

Figure 2:
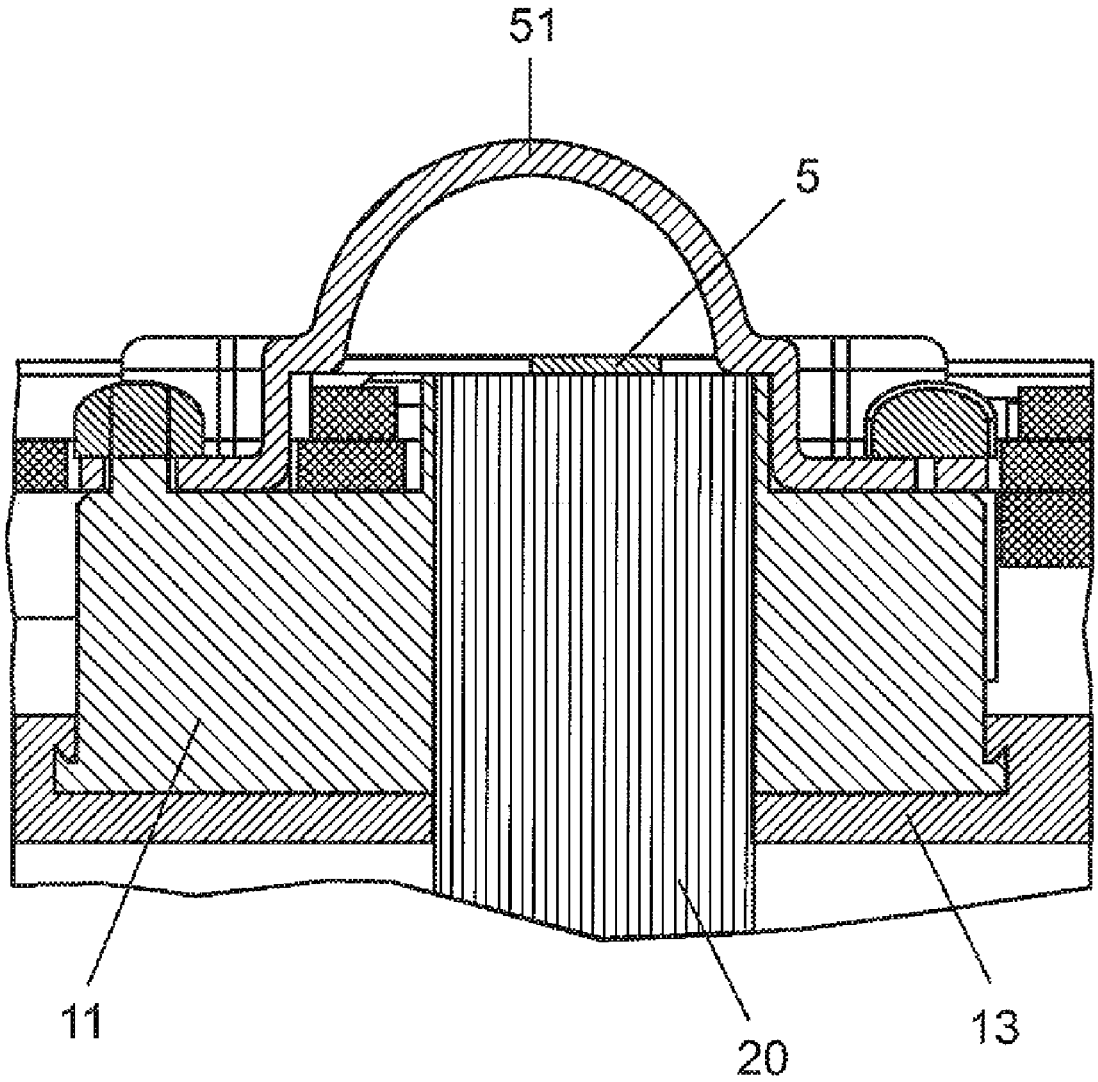
FIG. 2 shows a detail drawing of the sectional semi-conductor light source module with the illustrated end of the incorporated heat pipe.

FIG. 2 shows a detail section through the light emitting diode module 11 with the housing 13. The heat pipe 20 is incorporated by its evaporator-side end 27 into the light emitting diode module 11 and extends as far as the multichip light emitting diode 5 in order that the heat loss that arises can be transported away as efficiently as possible. The heat is transported by the heat pipe via the evaporated working medium into the condensation zone and absorbed there by the cooling body 31 (not shown in FIG. 2).

Figure 3:
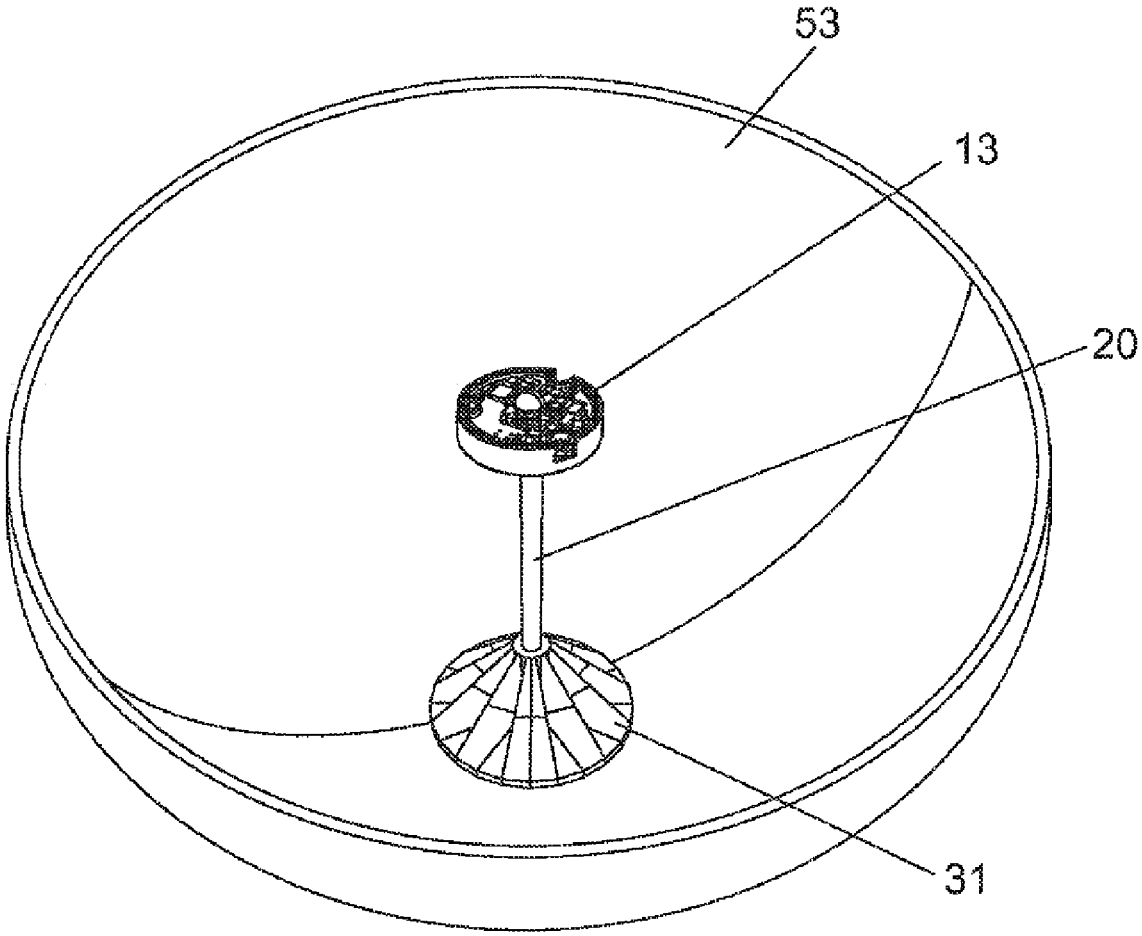
FIG. 3 shows a perspective view of the above arrangement, built into a lamp shade.

FIG. 3 shows the entire arrangement built into a reflector shade 53. The cooling body 31 is fitted to the reflector shade 53 centrally. All of the heat generated is therefore dissipated toward the reflector shade 53.

In the case of motor vehicle headlights according to the prior art, however, there is often the problem of the diffusing screen becoming iced over. Said diffusing screen has to be heated in winter, otherwise ice crystals form on the outer side and they can result in oncoming traffic being severely dazzled. Therefore, it would be an appropriate option to use the waste heat of the light emitting diodes for heating the diffusing screen. The structural space at the front side of a motor vehicle headlight is limited, however, such that the size of a cooling body fitted there is often insufficient to be able to always completely absorb the thermal energy generated by the light emitting diodes during operation of the headlight 1 in warm surroundings.

Figure 4:
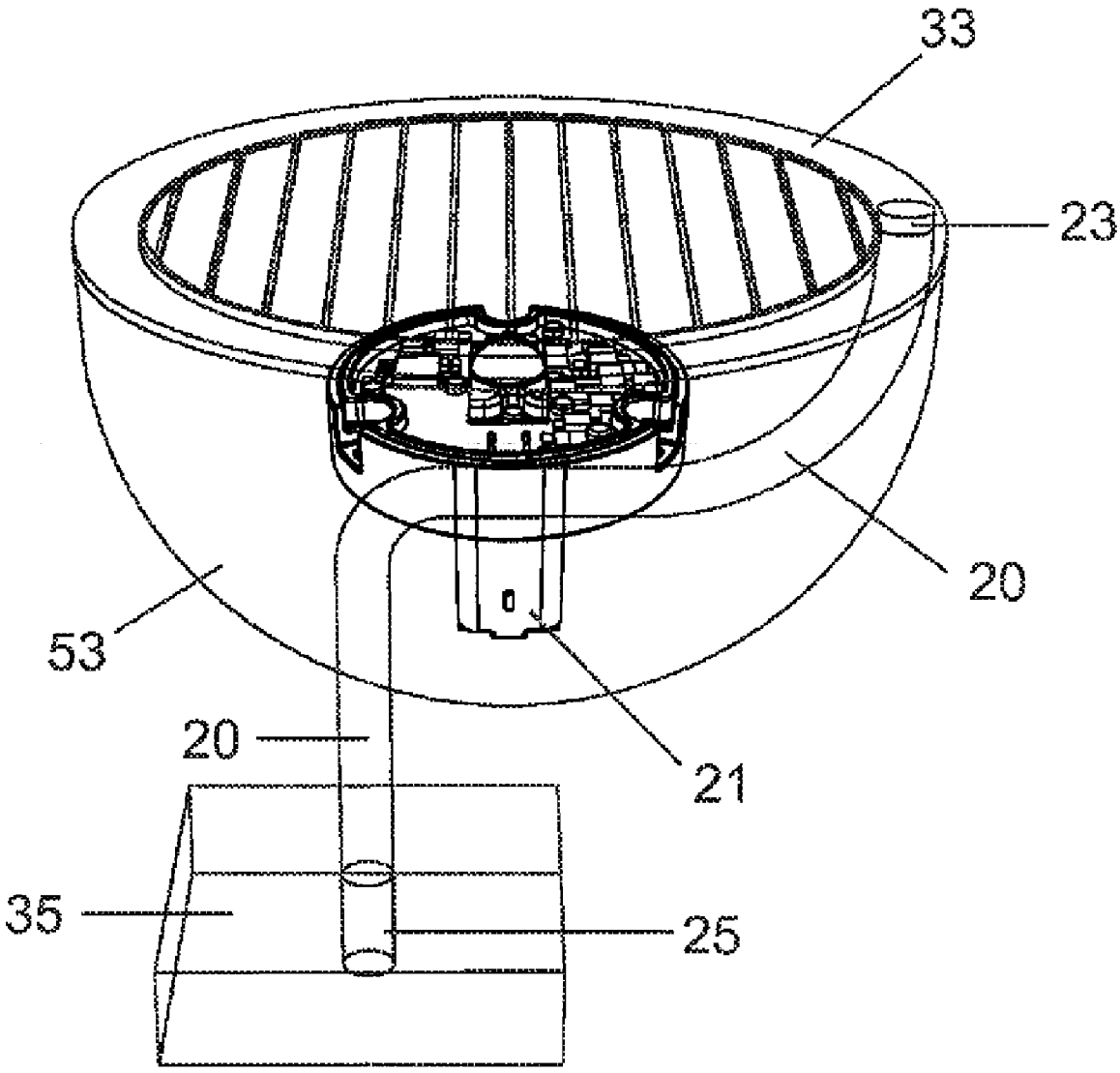
FIG. 4 shows a perspective view of an arrangement according to an embodiment of the invention for cooling semiconductor light sources with two independent heat sinks each respectively connected to a condensation zone, wherein it is possible to switch over between the condensation zones.

FIG. 4 shows a perspective view of an arrangement according to the invention for cooling semiconductor light sources, which solves the problem mentioned above. In this case, the arrangement is a motor vehicle headlight in which the waste heat of the multichip light emitting diode 5 is passed via a heat pipe 20 to a condensation zone 23, which is cooled by a heat sink 33 and thus heats the diffusing screen 37. The arrangement according to the invention for cooling semi-conductor light sources has two heat sinks 33, 35 that can be switched over. The switching over is realized by means of a temperature-controlled valve in the heat pipe 20. The first heat sink 33 serves, as described above, as a heating system, e.g. for headlight deicing. The temperature control is designed such that this task is accomplished as a priority, that is to say this heat sink 33 is in operation only for as long as thermal energy is required here. Once the desired temperature has been reached, a switch-over is made to a second heat sink 35. The latter is designed
to be able always and at any time to absorb the heat flow that arises.

In this case, the second heat sink 35 can be a sufficiently large cooling body. However, it is also conceivable for the second heat sink 35 to be connected to an existing cooling system or a cooling system to be provided for this purpose. In this case, the second heat sink 35 can be connected e.g. to the water cooling system of the motor vehicle. However, it is also possible to provide a Peltier element, for example, which is connected to the second heat sink 35.

The heat pipe 20 has a switch-over valve 21, by means of which it is possible to switch over between two condensation zones 23, 25 with the correspondingly connected heat sinks 33, 35. In this case, the first heat sink 33 is embodied as a ring around the diffusing screen 37 of the headlight 1. This makes it possible to heat up the diffusing screen 37 in poor weather to an extent such that formation of ice crystals is reliably prevented. In this case, the control of the switch-over valve 21 is configured such that, starting from a specific temperature of the ring around the diffusing screen 37, a switch-over is made to the second condensation zone 25 in order to ensure efficient cooling of the multichip light emitting diode 5 and to prevent overheating of the heat sink 33.

In this case, the power feed to the multichip light emitting diodes 5 is realized by means of the heat pipe itself, which is composed of an electrically conductive material such as aluminum or copper. If two of these conductive pipes are arranged coaxially one inside the other with an insulation in between, then this gives rise to a cost-effective and robust power feed for the multichip light emitting diodes 5 and the electronics arranged on the module 11.

Figure 5:
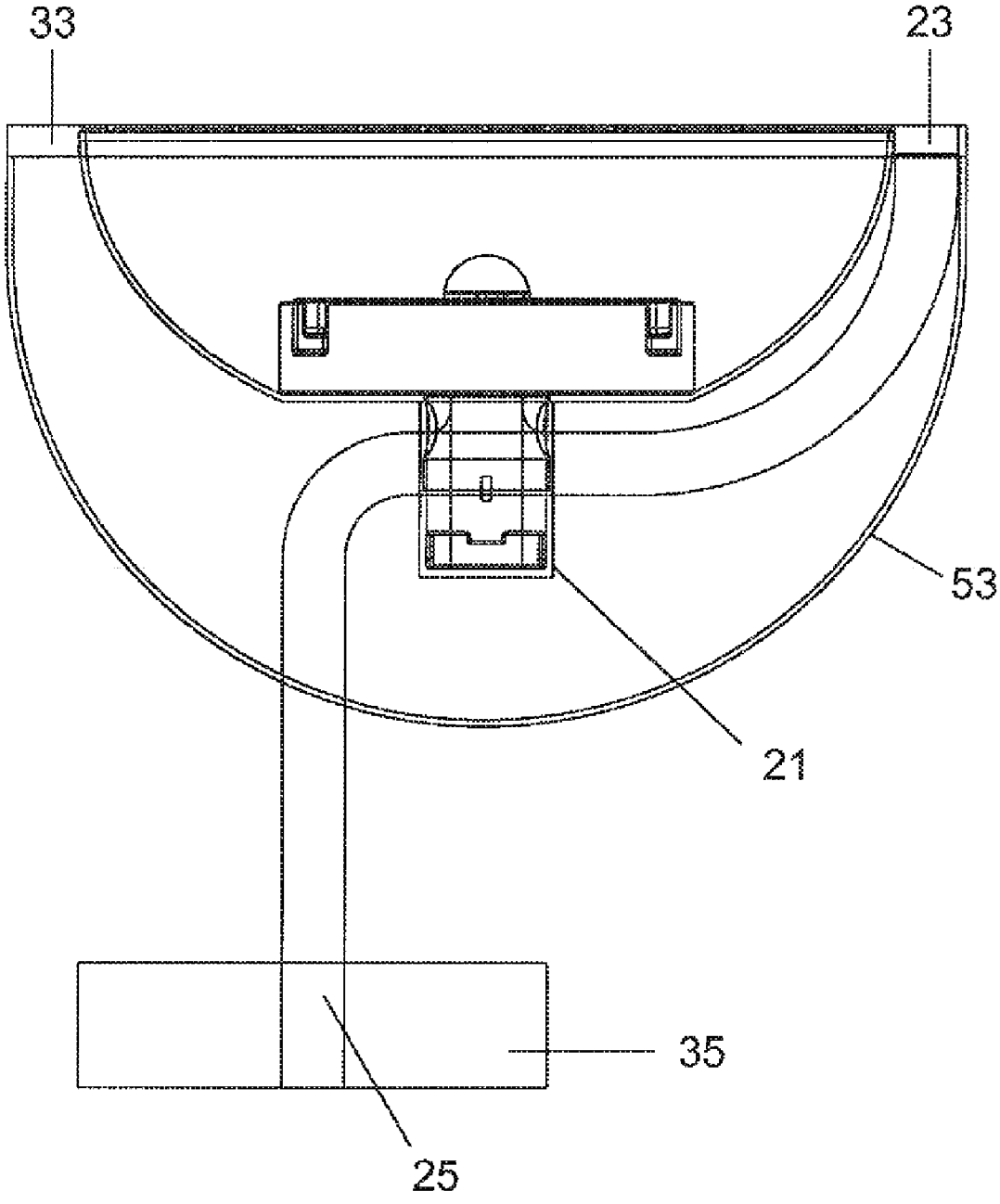
FIG. 5 shows a schematic side view of an arrangement according to an embodiment of the invention for cooling semiconductor light sources.

FIG. 5 shows a schematic side view of the arrangement according to the invention for cooling semiconductor light sources. As already indicated above, the switch-over valve 21 is controlled in such a way that after the multichip light emitting diode 5 has been switched on, the first condensation zone 23 with the first heat sink 33 is active. If the first heat sink has reached a specific temperature, then the switch-over valve 21 switches over to the second condensation zone 25 with the second heat sink 35. The latter is arranged behind the lamp shade 53, and is dimensioned in terms of size such that it can at any time absorb the thermal energy that arises. If the temperature is not reached on account of cold weather conditions, then the first heat sink 33 remains permanently active in order to prevent formation of ice crystals on the diffusing screen 37 as far as possible.

Figure 6:
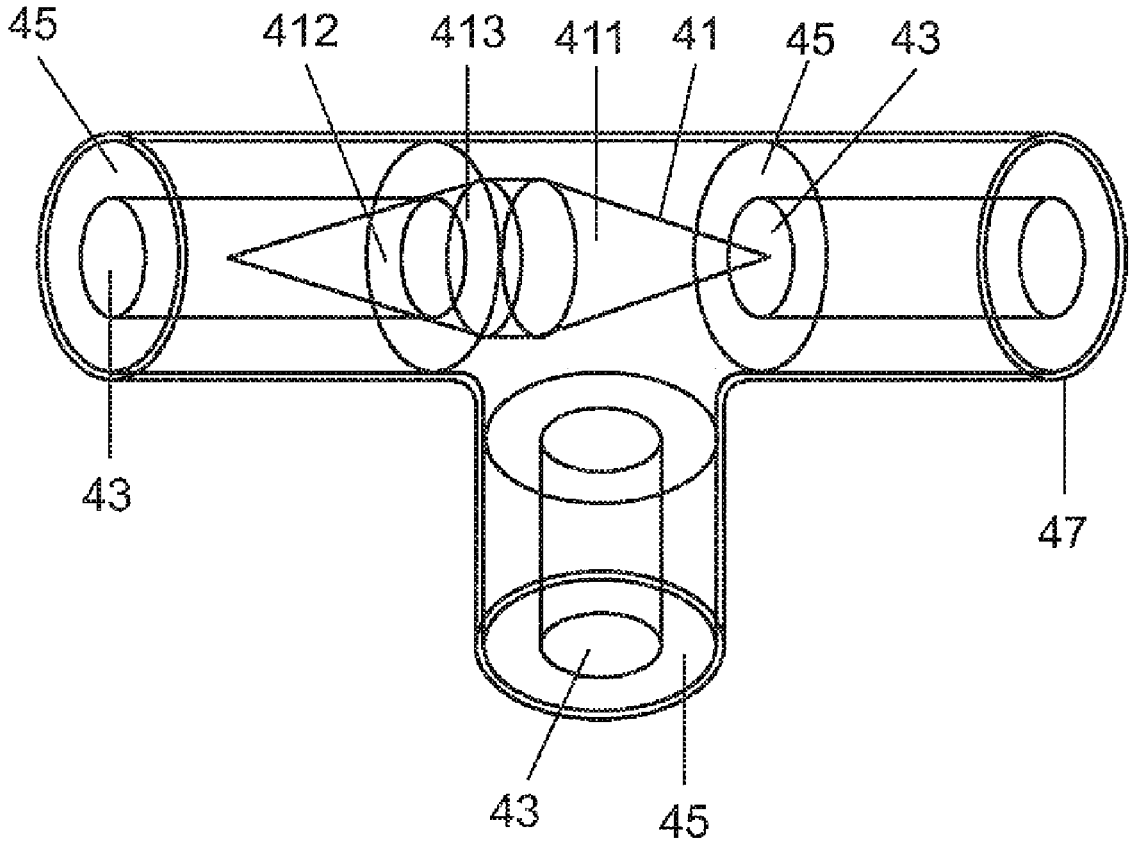
FIG. 6 shows a perspective detail view of a switch-over valve according to an embodiment of the invention.

FIG. 6 shows a schematic detail drawing of the switch-over valve 21. The latter is composed of a T-shaped pipe piece, into which a permanent-magnetic double cone is introduced. The latter is composed of two conical parts 411, 412, which, at the base, are oriented profile-identically or congruently with respect to one another, such that the cone vertices point in opposite directions. A cylindrical section 413 can additionally lie between the two base surfaces. However, the base surfaces can also be arranged in a manner offset relative to one another (not shown), such that a cylindrical bevel arises between the two base surfaces. The base surfaces of the cones 411, 412 can also have an oval or ovoid shape (not shown). Polygons are also possible as a shape of the base surface. The cone 411, 412 is then shaped in accordance with the base surface (not shown). This double cone 41 is situated in the center of the T-shaped pipe piece. The cross section of the heat pipe 20 is shown at the cut ends. The outer enclosure is composed of a gastight pipe 47, into which a capillary pipe 45 composed of a porous material is introduced. The evaporator pipe 43 lies within the capillary pipe 45. In the region of the double cone, the capillary pipe is cut out or at least the wall thickness is made weaker. The base diameter of the double cone 41 is larger than the diameter of the evaporator pipe 43. The vertices of the double cone 41 respectively face the first and second condensation zones 23, 25. The cone 41 can penetrate into the evaporator pipe 43 until it has completely closed off the latter. The capillary pipe 45 remains unaffected by this, such that working medium flowing back can pass into the evaporator zone 27 again. This contributes to an efficient mode of operation of the heat pipe 20. Suitable controlled electromagnets (not shown) are arranged externally on the T-piece. Said electromagnets, depending on the driving, can force the permanent-magnetic double cone 41 into the end of the evaporator pipe 43 of the first or the second condensation zone 23, 25 and therefore close off the latter. It is therefore possible to switch over between the two cooling paths without the heat flow overall being impaired. By virtue of the construction as a 3-way valve 21, a heat flow into one of the condensation zones 23, 25 is always ensured.

The scope of protection of the invention is not limited to the examples given herein above. The invention is embodied in each novel characteristic and each combination of characteristics, which includes every combination of any features which are stated in the claims, even if this feature or combination of features is not explicitly stated in the examples.

The invention claimed is:

1. An arrangement for cooling semiconductor light sources, wherein the semiconductor light sources are arranged on a heat-conducting module, which is operatively connected to an evaporator zone of a heat pipe, wherein a first condensation zone of the heat pipe is connected to a first heat sink, wherein the heat pipe is connected to at least one second condensation zone with at least one second heat sink, and a heat flow can be switched over between the condensation zones or the second condensation zone can be switched in.

2. The arrangement as claimed in claim 1, wherein the arrangement has a 3-way valve for switching over the heat flow into the first and second condensation zones.

3. The arrangement as claimed in claim 2, wherein the 3-way valve contains a permanent-magnetic double cone, and the cone vertices respectively alternately close off the end of an evaporator pipe of a condensation zone.

4. The arrangement as claimed in claim 3, wherein a capillary pipe arranged coaxially around the evaporator pipe is always open.

5. The arrangement as claimed in claim 3, wherein a drive of the double cone is arranged outside the heat pipe.

6. The arrangement as claimed in claim 3, wherein the drive of the double cone is effected magnetically.

7. The arrangement as claimed in claim 1, wherein when the semiconductor light sources are activated, the evaporator pipe is open to the first condensation zone and the evaporator pipe is closed off to the second condensation zone.

8. The arrangement as claimed in claim 1, comprising a device for switching over the heat flow into the condensation zones depending on the temperature of the first condensation zone.

9. The arrangement as claimed in claim 1, comprising a 2-way valve for switching on and off the heat flow into the second condensation zone, wherein the heat flow into the first condensation zone is always possible.

10. The arrangement as claimed in claim 1, wherein the heat pipe is simultaneously at least one power feed for the semiconductor light sources.

11. The arrangement as claimed in claim 9, wherein the power feed is realized via at least two coaxial pipes.

12. The arrangement as claimed in claim 1, wherein the heat sink of the first condensation zone is operatively connected to a heating device.

13. A headlight comprising an arrangement as claimed in claim 11, wherein the arrangement has the heating device for heating a diffusing screen of the headlight.

14. The headlight as claimed in claim 12, wherein the second condensation zone is arranged below the headlight and is airflow-cooled.

15. The headlight as claimed in claim 14, wherein the second condensation zone is arranged behind the headlight.

16. A method for cooling semiconductor light sources with an arrangement as claimed in claim 1, comprising the steps of:

switching on a first condensation zone upon activation;

upon a predetermined temperature of the first condensation zone being exceeded, switching off the first condensation zone and switching on a second condensation zone or switching in a second condensation zone; and upon a predetermined temperature of the first condensation zone being undershot, switching over to the first condensation zone or switching off the second condensation zone.

* * * * *